United States Patent [19]

Horrell

[11] 4,265,146

[45] May 5, 1981

[54] DEVICE FOR SHARPENING LAWN MOWER BLADES

[76] Inventor: Charles I. Horrell, Rte. 2, Hardy, Ark. 72542

[21] Appl. No.: 26,441

[22] Filed: Apr. 2, 1979

[51] Int. Cl.[3] ..... B21K 19/00

[52] U.S. Cl. ..... 76/82.1; 51/92 BS; 51/231

[58] Field of Search ..... 76/82, 82.1, 82.2; 51/241 R, 74 BS, 77 BS, 80 BS, 83 BS, 84 BS, 91 BS, 92 BS, 166 TS, 166 FB, 231

[56] References Cited

U.S. PATENT DOCUMENTS

| | | | |
|---|---|---|---|
| 2,589,165 | 3/1952 | Toy et al. | 51/166 FB |
| 2,879,629 | 3/1959 | Machovec | 51/48 HE |
| 2,888,965 | 6/1959 | Phillips | 51/166 FB |
| 3,061,980 | 11/1962 | Machovec | 51/247 |
| 3,755,971 | 9/1973 | Garcia | 51/92 BS |
| 3,879,899 | 4/1975 | Ribar | 51/92 BS |
| 4,065,886 | 1/1978 | Harwood et al. | 51/166 FB |

FOREIGN PATENT DOCUMENTS

| | | | |
|---|---|---|---|
| 557218 | 12/1974 | Switzerland | 51/92 BS |

*Primary Examiner*—Othell M. Simpson
*Assistant Examiner*—Roscoe V. Parker
*Attorney, Agent, or Firm*—Walker & McKenzie

[57] ABSTRACT

A device for use with a portable electric drill having an abrasive wheel attached thereto for rotation thereby. The device includes a base for holding the drill in a substantially horizontal position and a clamp for holding a lawn mower blade. A rail is adjustably attached to the base. A rail follower is slidably attached to the rail for reciprocating movement thereon substantially parallel to the longitudinal axis of the abrasive wheel. The clamp is fixedly attached to the rail follower. When the rail is adjusted so that the cutting edge of the blade held in the clamp is in contact with the abrasive wheel and when the drill is activated to rotate the abrasive wheel, reciprocation of the rail follower will cause the cutting edge of the blade to be sharpened.

8 Claims, 11 Drawing Figures

FIG. 1
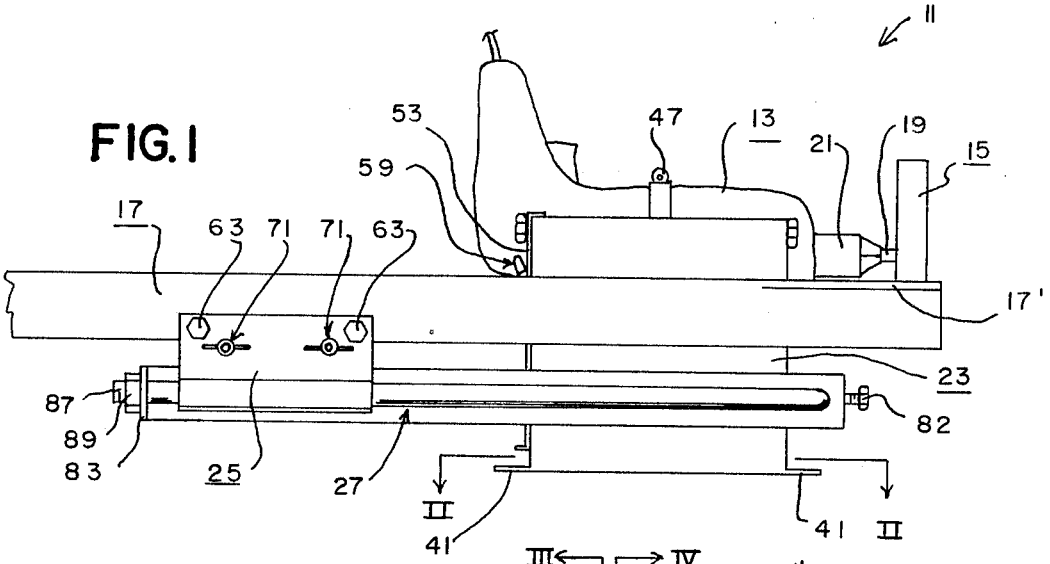
FIG. 2
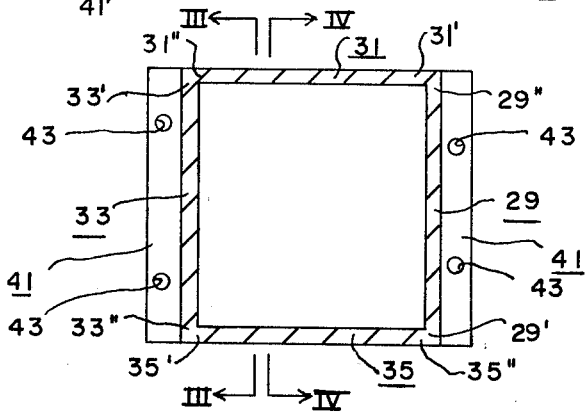
FIG. 3
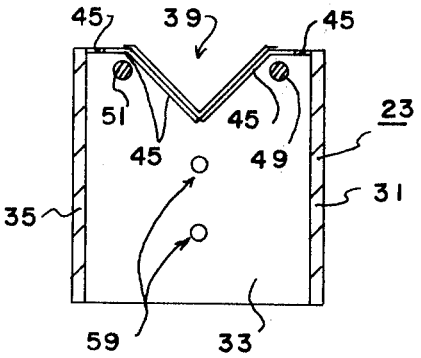
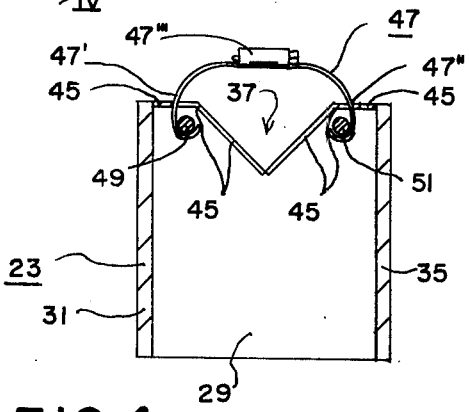
FIG. 4

DEVICE FOR SHARPENING LAWN MOWER BLADES

BACKGROUND OF THE INVENTION

1. Field of the Invention

This invention relates to devices for attachment to portable electric hand drills to allow the drill to be used as a grinder to sharpen lawn mower blades and the like.

2. Description of the Prior Art

Phillips, U.S. Pat. No. 2,888,965, discloses an attachment for a portable electric drill to allow the drill to be used as a grinder to sharpen tools (see FIGS. 10 and 11 of the Phillips patent). Machovec, U.S. Pat. No. 2,879,629, and U.S. Pat. No. 3,061,980, disclose devices for sharpening the blade of a lawn mower in which an abrasive wheel is reciprocated along the blade to be sharpened. Garcia, U.S. Pat. No. 3,755,971, discloses a device for sharpening shears and scissors. Ribar, U.S. Pat. No. 3,879,899, discloses a device for sharpening scissors. None of the above patents disclose or suggest the present invention.

SUMMARY OF THE PRESENT INVENTION

The present invention is directed towards providing a device for sharpening lawn mower blades. The concept of the present invention includes a base means for holding a portable electric hand drill having an abrasive wheel mounted thereon, a clamp means for holding a lawn mower blade, and an attachment means for attaching the clamp means to the base means in such a way that the clamp means can be reciprocated back and forth whereby the cutting edge of the blade is reciprocated back and forth across the abrasive wheel.

BRIEF DESCRIPTION OF THE DRAWINGS

FIG. 1 is a front elevational view of the device of the present invention shown associated with a portable electric hand drill, an abrasive wheel, and a lawn mower blade.

FIG. 2 is a sectional view as taken on line II—II of FIG. 1.

FIG. 3 is a sectional view as taken on line III—III of FIG. 2.

FIG. 4 is a sectional view as taken on line IV—IV of FIG. 2.

DESCRIPTION OF THE PREFERRED EMBODIMENT

Figure 10:
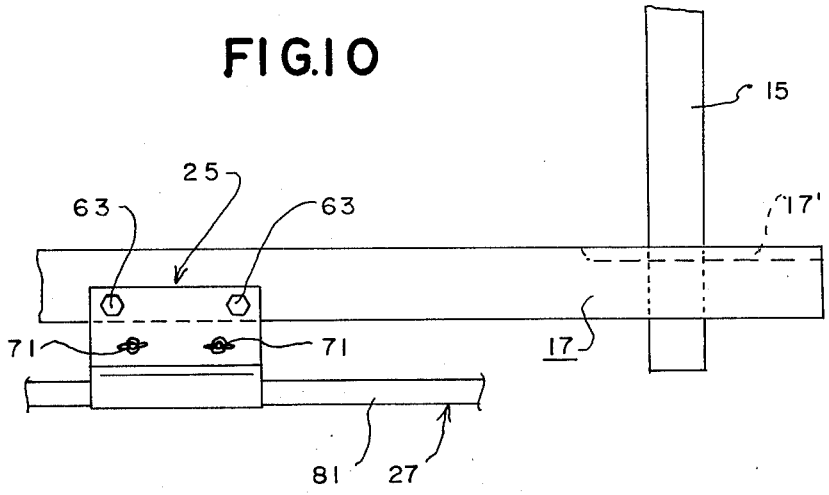
FIG. 10 is a somewhat diagrammatic view showing the device of the present invention associated with one type of lawn mower blade.
Figure 11:
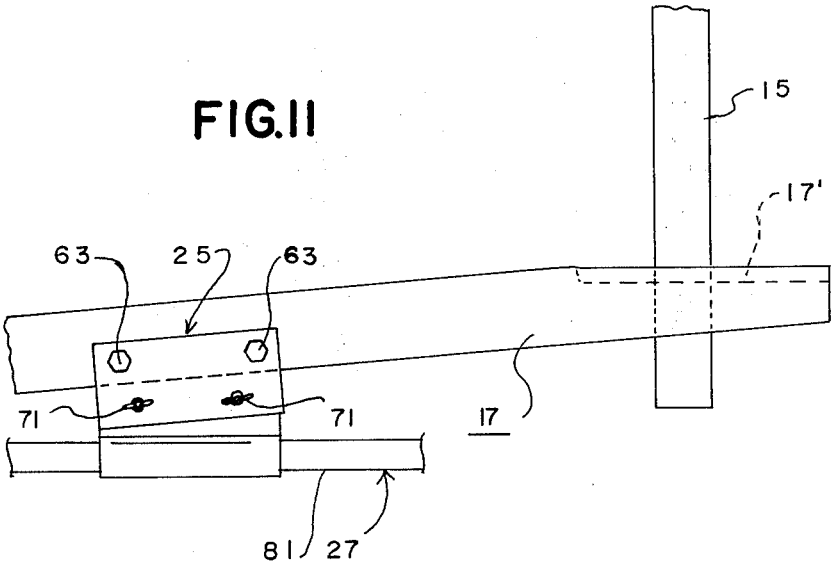
FIG. 11 is a somewhat diagrammatic view showing the device of the present invention associated with another type of lawn mower blade.

The device 11 of the present invention is for use with a portable electric hand drill 13 and an abrasive wheel 15 to sharpen a lawn mower blade 17. The abrasive wheel 15 is the type which includes means such as a stud 19 for allowing it to be attached to the chuck 21 of the drill 13 in a manner well known to those skilled in the art for allowing the abrasive wheel 15 to be rotated by the drill 13. The device 11 includes, in general, a base means 23 for selectively holding the drill 13 in a substantially horizontal position, a clamp means 25 for selectively holding the blade 17, and an attachment means 27 for attaching the clamp means 25 to the base means 23 so as to allow the clamp means 25 to reciprocate back and forth in a direction substantially parallel to the longitudinal axis of the abrasive wheel 15 to allow the cutting edge 17' of the blade 17 to be brought into reciprocating contact with the outer edge of the abrasive wheel 15 as illustrated in FIGS. 10 and 11 whereby the cutting edge 17' is sharpened.

The base means 23 preferably includes a first wall 29 having a first side edge 29' and a second side edge 29'', a second wall 31 having a first side edge 31' and a second side edge 31'', a third wall 33 having a first side edge 33' and a second side edge 33'', and a fourth wall 35 having a first side edge 35' and a second side edge 35''. The second side edge 29'' of the first wall 29 is preferably attached to the first side edge 31' of the second wall 31. The second side edge 31'' of the second wall 31 is preferably attached to the first side edge 33' of the third wall 33. The second side edge 33'' of the third wall 33 is preferably attached to the first side edge 35' of the fourth wall 35. The second side edge 35'' of the fourth wall 35 is preferably attached to the first side edge 29' of the first wall 29. The first wall 29 preferably has a V-shaped notch 37 in the upper edge thereof for receiving a portion of the drill 13. The third wall 33 preferably has a V-shaped notch 39 in the upper edge thereof for receiving a portion of the drill 13. A flange 41 may be provided on the bottom edge of the first and third wall 29, 33 for allowing the base means 23 to be fixedly attached to a table or the like (not shown). That is, apertures 43 may be provided through the flanges 41 for allowing screws, nails, or the like to pass therethrough to attach the base means 23 to a table or the like. The top edges of the walls 29, 31, 33, 35 may be provided with an inwardly turned flange 45 for strengthening the base means 23 and the like. The base means 23 preferably includes a strap member 47 having a first end 47' attached substantially to the second wall 31 and having a second end 47'' attached substantially to the fourth wall 35 and for passing over a portion of the drill 13 to secure the drill 13 against the top edges of the first and third wall 29, 33 within the V-shaped notches 37, 39. The strap member 47 is preferably adjustable in any manner apparent to those skilled in the art for allowing drills 13 of various sizes and shapes to be securely attached in the base means 23. For example, the first and second ends 47', 47'' of the strap member 47 may be joined together by an adjustable buckle-like member 47'''. The base means 23 may include a first rod member 49 extending between the first wall 29 and third wall 33 substantially adjacent the top edge of the second wall 31 and may include a second rod member 51 extending between the first wall 29 and third wall 33 substantially adjacent the fourth wall 35. The first end 47' of the strap member 47 may be secured to the first rod member 49 and the second end 47'' of the strap member 47 may be secured to the second rod member 51 as clearly shown in the drawings (see, for example, FIG. 4). The first and second rod members 49, 51 may consist simply of elongated bolt means secured to the first and third walls 29, 33.

The device 11 may include a plate member 53 slidably attached to the third wall 33 and having a V-shaped notch 55 in the upper edge thereof substantially the same shape and size as the V-shaped notch 39. The plate member 53 is movable between a position substantially aligned with the V-shaped notch 39 of the third wall 33 and infinite positions higher than the V-shaped notch 39 of the third wall 33 whereby the drill 13 can be positioned on the base means 23 with the axis of the abrasive wheel 15 substantially horizontally aligned regardless of the exterior shape of the drill 13. The plate member 53 may be slidably attached to the third wall 33 in any manner apparent to those skilled in the art. For example, the plate member 53 may have a pair of slots 57 therein, and a pair of bolt means 59 may pass through the third wall 33 and through the slots 57 in the plate member 53 whereby the plate member 53 is adjustably mounted to the third wall 33.

The clamp means 25 has a groove 61 thereacross for receiving a portion of the blade 17 and includes lock means for selectively locking the blade 17 in the groove 61. The lock means may consist simply of a pair of screws 63 for extending through a portion of the body of the clamp means 25 and into the groove 61 whereby the screws 63 can be selectively screwed against a portion of the blade 17 to clamp the blade 17 against a portion of the body of the clamp means 25. The clamp means 25 preferably includes a first plate member 65 and a second plate member 67. The second plate member 67 includes a shoulder portion 67' defined by an intermediate member 69. The members 65, 67, 69 are preferably joined one to the other by a pair of bolt means 71. The second plate member 67 and intermediate member 69 are preferably moveable relative to the first plate member 65. More specifically, the first plate member 65 preferably has a pair of slots 73 through which the bolt means 71 pass whereby the second plate member 67, intermediate member 69 and bolt means 71 can be moved relative to the first plate member 65 and whereby the clamp means 25 can be adjusted for different size and shape blades 17 as will be apparent to those skilled in the art. The intermediate member 69 may be substantially fixedly attached to the second plate member 67 with a distal end of the second plate member 67 extending past the intermediate member 69 whereby the groove 61 is defined by the distal portions of the first and second plate members 65, 67 which extend past the intermediate member 69. The screws 63 preferably screwably extend through the distal portion of the second plate member 67 whereby a portion of the blade 17 may be inserted into the groove 61 until it contacts the intermediate member 69 and the screws 63 can then be screwed through the second plate member 67 and against the blade 17 until the blade 17 is clamped between the screws 63 and the first plate member 65 with one edge of the blade 17 resting against the shoulder portion 67'.

The attachment means 27 includes a rail means 75 for being attached to the base means 23 and includes a rail follower means 77 for being attached to the clamp means 25 and for reciprocating movement along the rail means 75. The rail means 75 preferably includes a first leg 79 having a first end 79' and a second end 79'' and preferably includes a second leg 81 having a first end 81' and a second end 81''. The first end 79' of the first leg 79 is preferably attached to the first end 81' of the second leg 81 at substantially a right angle thereto. The second end 79'' of the first leg 79 is slidably positioned in an aperture in the base means 23 in a direction substantially perpendicular to the longitudinal axis of the abrasive wheel 15 when the abrasive wheel 15 is mounted in the drill 13 and the drill 13 is attached to the base means 23 so that the second leg 81 is substantially parallel to the longitudinal axis of the abrasive wheel 15 and so that the second leg 81 can be moved between an infinite number of positions along a plane substantially parallel to a horizontal plane passing through the longitudinal axis of the abrasive wheel 15. A lock means is included for selectively locking the second leg 81 in one of the infinite number of positions. More specifically, a screw member 82 may be provided for being selectively screwed through a portion of the base means 23 and against the first leg 79 to thereby selectively prevent movement of the first leg 79 in the aperture in the base means 23. The base means 23 preferably includes an ear member 83 for selective engagement with the second end 81'' of the second leg 81. The ear member 83 has a slot 85 therein, and the second end 81'' of the second leg 81 includes a finger portion 87 for extending through the slot 85. The finger portion 87 is preferably threaded and a nut member 89 is provided to coact with the threaded finger portion 87 and selectively attach the second end 81'' of the second leg 81 to the ear member 83. The base means 23 may include an elongated member 91 attached to the fourth wall 35 in any manner apparent to those skilled in the art such as by way of screws, welding or the like. The elongated member 91 has a first end 91' that extends past the first side edge 35' of the fourth wall 35. The first end 91' of the elongated member 91 is preferably bent at a right angle to form the ear member 83. The elongated member 91 has a second end 91'' that extends past the second side edge 35'' of the fourth wall 35 and is bent at a 90° angle in two places with the extreme end thereof attached to the first wall 23 by welding or the like to form a boss member 93 as clearly shown in the drawings. Apertures 95 extend through the boss member 93 to allow the first end 79' of the first leg 79 to extend therethrough.

The rail follower means 77 may consist of a collar member 99 loosely encircling the second leg 81 for reciprocating movement back and forth thereon. The first plate member 65 of the clamp means 25 is preferably fixedly attached to the collar member 99 in any manner apparent to those skilled in the art such as by welding.

Figure 5:
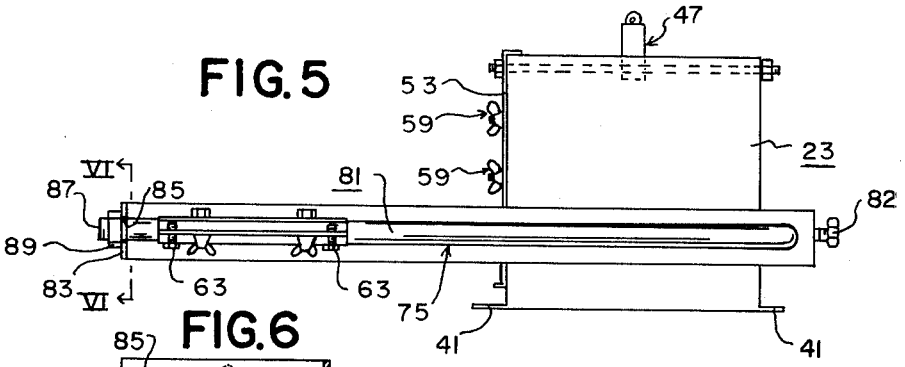
FIG. 5 is a front elevational view of the device of the present invention.
Figure 6:
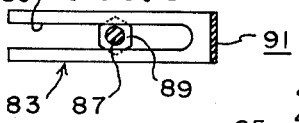
FIG. 6 is a sectional view as taken on line VI—VI of FIG. 5.
Figure 7:
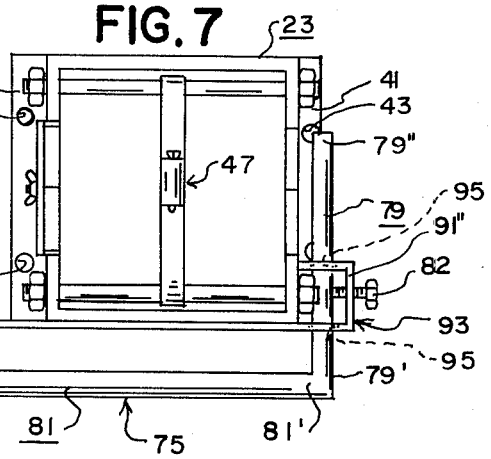
FIG. 7 is a top plan view of the device of the present invention.
Figure 8:
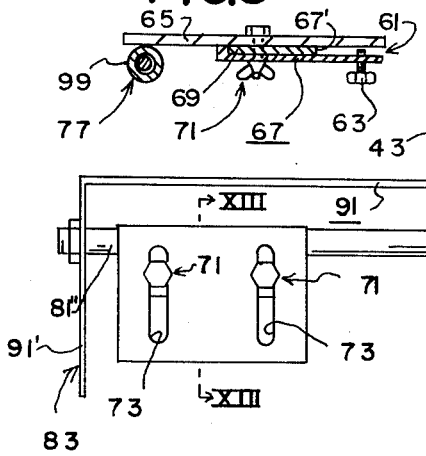
FIG. 8 is a sectional view as taken on line VIII—VIII of FIG. 7.
Figure 9:
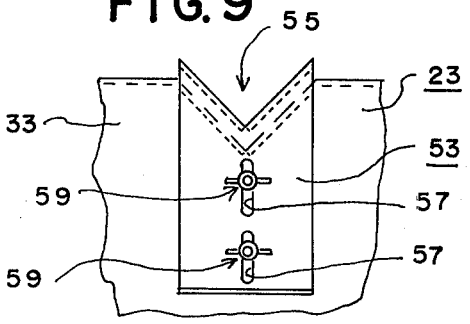
FIG. 9 is a side elevational view of a portion of the device of the present invention.

The use of the device 11 is quite simple. First, the abrasive wheel 15 is attached to the drill 13 and the drill 13 placed in the V-shaped notches 37, 39, 55. The plate member 53 is adjusted so that the longitudinal axis of the abrasive wheel 15 is substantially horizontal, i.e., substantially aligned with the longitudinal axis of the second leg 81. The strap member 47 is then adjusted to securely clamp the drill 13 in place. The blade 17 can then be secured to the clamp means 25. The clamp means 25 can be adjusted to properly align the cutting edge 17' of the blade 17 with the abrasive wheel 15 as will be apparent to those skilled in the art. This allows the device 11 to be used with blades 17 having different type cutting edges 17' as illustrated by FIGS. 9 and 10. The drill 13 is then activated in any manner apparent to those skilled in the art to cause the abrasive wheel 15 to rotate. The blade 17 is then reciprocated back and forth along the abrasive wheel 15 until it is sufficiently sharpened.

Although the present invention has been described and illustrated with respect to a preferred embodiment thereof, it is not to be so limited since changes and modifications may be made therein which are within the full intended scope of the invention.

I claim:

1. A lawn mower blade sharpening device for use with a motor having an abrasive wheel attached thereto, said device comprising:

(a) clamp means for holding said lawn mower blade;

(b) attachment means for attaching said clamp means to said motor so as to allow said clamp means to be manually reciprocated back and forth substantially parallel to the longitudinal axis of said abrasive wheel with the cutting edge of said lawn mower blade in contact with said abrasive wheel, said attachment means including a rail means for being attached to said motor and a rail follower means for being attached to said clamp means and for reciprocating movement along said rail means, said rail means including a first leg for being slidably attached to said motor and including a second leg fixedly attached to said first leg for movement between an infinite number of positions along a plane substantially parallel to a horizontal plane passing through the longitudinal axis of said abrasive wheel; and (c) lock means for selectively locking said second leg of said rail means in one of said infinite number of positions.

2. A lawn mower blade sharpening device for use with a portable electric hand drill having an abrasive wheel attached thereto, said device comprising:

(a) base means for holding said drill;

(b) clamp means for holding said lawn mower blade;

(c) attachment means for attaching said clamp means to said base means so as to allow said clamp means to be manually reciprocated back and forth substantially parallel to the longitudinal axis of said abrasive wheel with the cutting edge of said lawn mower blade in contact with said abrasive wheel, said attachment means including a rail means for being attached to said base means and a rail follower means for being attached to said clamp means and for reciprocating movement along said rail means, said rail means including a first leg having first and second ends and including a second leg having first and second ends, said first end of said first leg being attached to said first end of said second leg at substantially a right angle thereto, said base means having an aperture therethrough, the longitudinal axis of said aperture being substantially perpendicular to the longitudinal axis of said abrasive wheel, said first leg being slidably positioned in said aperture with said second leg substantially parallel to the longitudinal axis of said abrasive wheel, said second leg being movable between an infinite number of positions along a plane substantially parallel to a horizontal plane passing through the longitudinal axis of said abrasive wheel, and (d) lock means for selectively locking said second leg in one of said infinite number of positions.

3. The device of claim 2 in which said lock means includes a screw member for being selectively screwed through said base means and against said first leg, in which said base means includes an ear member for selective engagement with said second end of said second leg, said ear member having a slot therethrough, said second end of said second leg including a finger portion for extending through said slot, and in which said lock means further includes a nut member for selective attachment to said finger portion to selectively clamp a portion of said ear member between said nut member and a portion of said second end of said second leg.

4. The device of claim 2 in which said rail follower means includes a collar member for loosely encircling said second leg, in which said clamp means includes a first plate member and a second plate member, said first plate member being fixedly attached to said collar member, said second plate member being movably attached to said first plate member and including a shoulder portion, and in which said clamp means includes lock means for locking said lawn mower blade to said first and second plate means with one edge of said lawn mower blade resting against said shoulder portion of said second plate member.

5. The device of claim 4 in which said lock means of said clamp means includes a screw member for being selectively screwed through said second plate member and against a portion of said lawn mower blade positioned between said first and second plate members to clamp said lawn mower blade against said first plate member.

6. The device of claim 5 in which said first plate member has an elongated slot therein, said elongated slot in said first plate member being directed substantially perpendicular to the longitudinal axis of said second leg; and in which clamp means includes bolt means for passing through said elongated slot in said first plate member and through said second plate member and for fixedly securing said first and second plate members together.

7. The device of claim 2 in which said base means includes a first wall having first and second side edges, a second wall having first and second side edges, a third wall having first and second side edges, and a fourth wall having first and second side edges; said second side edge of said first wall being attached to said first side edge of said second wall, said second side edge of said second wall being attached to said first side edge of said third wall, said second side edge of said third wall being attached to said first side edge of said fourth wall, said second side edge of said fourth wall being attached to said first side edge of said first wall; said first wall having a V-shaped notch in the upper edge thereof for receiving a portion of said drill; said third wall having a V-shaped notch in the upper edge thereof for receiving a portion of said drill; and in which said base means includes a strap member for passing over a portion of said drill to secure said drill against said V-shaped notches of said first and third wall.

8. The device of claim 7 in which said strap member is adjustable and in which is included a plate member slidably attached to said third wall, said plate member having a V-shaped notch in the upper edge thereof for receiving a portion of said drill, said plate member being movable between a position substantially aligned with said V-shaped notch of said third wall and infinite positions higher than said V-shaped notch of said third wall.

* * * * *